United States Patent [19]

Coker et al.

[11] 4,212,714

[45] Jul. 15, 1980

[54] ELECTROLYSIS OF ALKALI METAL HALIDES IN A THREE COMPARTMENT CELL WITH SELF-PRESSURIZED BUFFER COMPARTMENT

[75] Inventors: Thomas G. Coker, Waltham; Anthony B. LaConti, Lynnfield; Edward N. Balko, Wilmington; George B. McGray, Wakefield, all of Mass.

[73] Assignee: General Electric Company, Wilmington, Mass.

[21] Appl. No.: 38,418

[22] Filed: May 14, 1979

[51] Int. Cl.[2] ..... C25B 1/16; C25B 1/26; C25B 9/00; C25B 13/08

[52] U.S. Cl. ..... 204/98; 204/128; 204/263

[58] Field of Search ..... 204/98, 128, 263–266

[56] References Cited

U.S. PATENT DOCUMENTS

| | | | |
|---|---|---|---|
| 3,933,603 | 1/1976 | Ishida et al. | 204/98 |
| 3,954,477 | 5/1976 | Arisaka et al. | 96/76 R |
| 4,025,405 | 5/1977 | Dotson et al. | 204/98 |
| 4,124,477 | 11/1978 | Tokawa et al. | 204/296 |

FOREIGN PATENT DOCUMENTS

| | | | |
|---|---|---|---|
| 2741956 | 3/1978 | Fed. Rep. of Germany | 204/98 |

*Primary Examiner*—R. L. Andrews
*Attorney, Agent, or Firm*—I. David Blumenfeld

[57] ABSTRACT

The invention describes a self pressurized three compartment, membrane cell and a process for electrolyzing aqueous halide solutions at low cell voltages and high cathode current efficiencies. Electrochemically active electrodes are physically bonded to ion exchanging membranes which divide the cell into three compartments. The mass transport characteristics of the membranes are selected so that water brought into the center or buffer compartment along with the halide ions exceeds water transport out of the compartment. This results in good electrode to current collector contact as the membranes to which the electrochemically active electrodes are permanently bonded are forced against the current collectors.

The instant invention relates to a process and apparatus for the electrolytic production of halogens and alkali metal hydroxides from aqueous alkali metal halide solutions. More particularly, it relates to the electrolysis of brine in a three compartment membrane cell having catalytic anode and cathode electrodes physically bonded to the permselective membranes which divide the cell into three compartments.

21 Claims, 3 Drawing Figures

C
$H_2O$ TRANSPORT (MOLES $H_2O$/MOLE $Na^+$)
4.5
4.0
3.5
3.0
2.5
2.0
1.5
0.0
0.05
0.10
0.15
0.20
0.25
0.30
0.35
0.40
$OH^-$ TRANSPORT (MOLES OH⁻/F)

ELECTROLYSIS OF ALKALI METAL HALIDES IN A THREE COMPARTMENT CELL WITH SELF-PRESSURIZED BUFFER COMPARTMENT

BACKGROUND OF THE INVENTION

It is now well known to electrolyze brine and other halides in the electrolytic cells containing anode and cathode compartments separated by a liquid and gas impervious permselective membrane. The voltages required for electrolysis of halides in such membrane cells are, however, relatively high; one of the reasons being that the electrochemically active anode and cathode surfaces are physically separated from the permselective membrane. This introduces IR drops due to the layers of electrolyte between the membrane and electrodes and IR drops due to gas blinding effects caused by bubbles or films of chlorine and hydrogen between the electrochemically active gas evolving electrode surfaces and the membrane. In a recently filed co-pending application Ser. No. 922,316, entitled Production of Halogens by Electrolysis of Alkali Metal Halides in an Electrolysis Cell Having Catalytic Electrodes Bonded to the Surface of a Solid Polymer Electrolyte Membrane, filed July 6, 1978, in the name of A. B. LaConti, et al, assigned to The General Electric Company, the assignee of the present invention, a process for producing alkali metal hydroxide and halogens is described in which the electrochemically active anode and cathode electrodes, in the form of porous, bonded masses of electrocatalytic and polymeric particles, are bonded directly to and embedded in the permselective membrane to form a unitary membrane-electrode structure. Substantial reductions in cell voltages are realized since the reaction sites are moved directly to the membrane and electrolysis takes place essentially at the interface of the bonded electrode and the membrane so that electrolyte IR drops and IR drops due to gas blinding effects are minimized. Current flow to the bonded embedded anode and cathode electrodes is by means of separate current collectors pressed against the bonded electrodes and connected to the cell power supply.

Good contact must be maintained between the current collectors and the electrodes in order to minimize ohmic losses and associated voltage drops at the collector/electrode interface. In the aforesaid LaConti application and cells of the type having electrode bonded directly to the surface of the membrane, the current collectors are clamped between the housing and membrane by mechanical, hydraulic or other clamping mechanisms to maintain good contact between the current collector and the electrode.

In the application (52-EE-0-327) Ser. No. 038,812 Coker, et al, filed May 14, 1979, concurrently with the instant application and assigned to The General Electric Company the assignee of the present invention, a process and electrolytic cell is described in which excellent electrode/current collector contact is maintained by utilizing a three compartment cell in which the buffer (or central) compartment is operated at a positive pressure with respect to the other compartments by supplying a pressurized feed to the buffer compartment. This forces the unitary membrane/electrode structure outward against the current collectors establishing uniform, constant and controllable contact pressure.

Applicants have found that it is possible to insure good electrode/current collector contact in a three chamber electrolyzer by operating the buffer compartment at a positive pressure differential generated solely by mass transport of $H_2O$ across the membrane. This results in self-pressurization of the buffer compartment thereby eliminating pressurizing equipment for the buffer compartment feed, i.e., pumps, filter, conduits, tanks, etc.

This is readily achieved by utilizing anode and cathode permselective membranes with controlled water transport characteristics. The membranes are chosen so that transport of water into the buffer compartment as ions move through the membranes is greater than that out of the buffer compartment. Pressurization of the buffer compartment is thus accomplished solely by passing current through the cell.

Use of a self-pressurized buffer compartment not only results in lower cell voltages but also increases the cathode current efficiency by discharging back migrating hydroxyl ions from the buffer compartment as sodium hydroxide. Current efficiencies of 90% or more at high caustic concentrations (5 M or higher) are readily achievable by incorporating multiple hydroxide rejection stages in a single cell process.

It is therefore, a principal objective of this invention to provide a three compartment electrolytic cell and a process for generating halogens and alkali metal hydroxide therein using a self-pressurized buffer compartment to maintain positive buffer compartment pressures with respect to the other compartments.

Another objection of the invention is to provide a three compartment electrolytic cell and an electrolysis process to be carried out therein in which the buffer compartment is self-pressurized to maintain uniform, constant, and controllable contact between the electrochemically electrodes physically bonded to the permselective membrane and the associated current collectors associated therewith.

Still another objective of the invention is to provide a three compartment electrolytic cell in which the buffer compartment is self-pressurized solely by passing current through the cell.

Yet another objective of the invention is to provide a highly efficient three compartment electrolytic cell and a process for generating chlorine and caustic therein in which the cell electrolysis voltage is minimized by maintaining uniform, constant and controllable contact pressure between the cell membranes by means of a buffer compartment which is self-pressurized to operate at a positive pressure with respect to the other compartments.

Other objectives and advantages of the invention will become apparent as the description thereof proceeds.

The objectives and advantages of the invention are realized in an electrolytic cell having a pair of liquid and gas impervious permselective membranes, which divide the cell into anode, cathode, and buffer compartments. Electrodes in the form of bonded masses of polymeric and electrochemically active particles are bonded to membranes and face the anode and cathode compartments. Separate current collectors are positioned in physical contact with the electrochemically active electrodes and connect them to a source of electrolyzing voltage. The two membranes have transport characteristics such that more water is carried by the ions into the buffer compartment than is carried out of it, so that pressure is built up rapidly in the buffer compartment by normal operation of the cell; i.e., by driving current through the cell. The positive pressure forces the membrane outward into firm contact with the current collectors thereby maintaining the desired uniform, constant contact pressure. By maintaining a positive pressure differential of at least 0.5 psi and up to 5 psi; and preferably in the range of 1–2 psi cell voltages in the range of 3.35 to 3.55 volts at 300 ASF are readily achievable and represent voltage improvements ranging from 0.6 to 1.5 volts over conventional three compartment cells at 300 ASF. The cell pressure is maintained at the desired value by pressure relief valves or standpipes associated with the buffer compartment.

The novel features that are believed to be characteristic of this invention are set forth in the appended claims. The invention itself, however, both as to its organization and mode of operation, together with further objectives and advantages thereof, may best be understood by reference to the following description taken in connection with the accompanying drawings in which:

Figure 1:
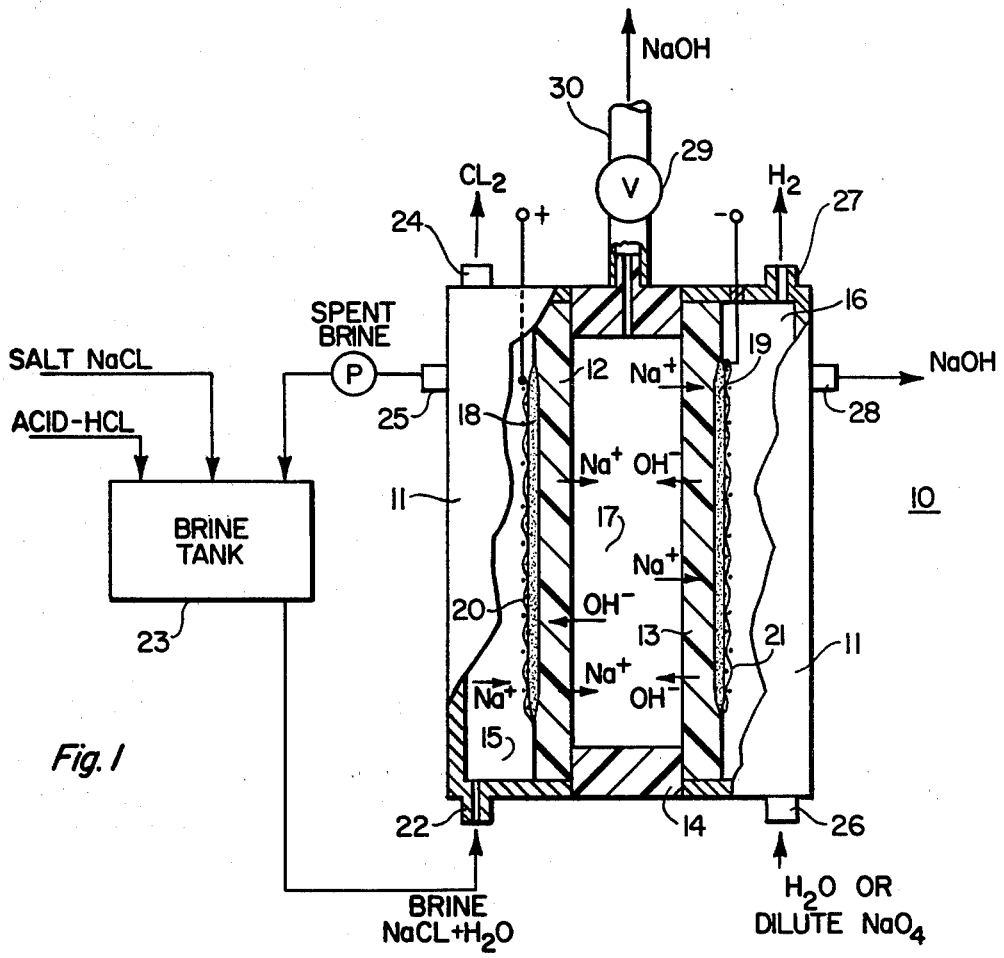
FIG. 1 is a schematic diagram of a three compartment electrolytic cell utilizing permselective membranes having catalytic electrodes bonded directly to the surfaces thereof.

FIG. 1 is a schematic illustration of a three compartment cell for electrolyzing alkali metal halides in which the buffer compartment is self pressurized by controlling a water transport through the cell membranes. Cell 10 includes a housing 11 which is divided by gas and liquid impervious permselective membranes 12 and 13, and a non conductive buffer chamber frame 14 into an anode compartment 15, a cathode compartment 16, and a buffer compartment 17. Anode and cathode electrodes 18 and 19 are respectively bonded to the surfaces of membranes 12 and 13 to form unitary electrode-membrane structures of which the electrode is an integral part facing the anode and cathode chambers respectively. The anode and cathode electrodes, as will be described in detail later, are porous, and gas permeable, and comprise bonded masses of electrocatalytic and polymeric particles. The electrochemically active catalytic particles are preferably particles of stabilized reduced oxides of a platinum group metal or dispersions of reduced metal particles and may include reduced oxides of a valve metal as well as electroconductive extenders such as graphite. The polymeric particles are preferably fluorocarbon particles such as polytetrafluoroethylene. The bonded mass of catalytic and polymeric particles is itself bonded to the surface of the membrane so that the electrode is dispersed over the major portions of the membrane surface and many individual particles contact the membrane at a plurality of points. This bonding of the electrode to the membrane is readily achieved by the application of heat and pressure to the bonded electrode mass when placed on the surface of the membrane.

Anode and cathode current collectors 20 and 21 are positioned adjacent to and in physical current conductive contact with the surfaces of the anode and cathode electrodes. The collectors are connected through suitable leads to the positive and negative terminals of a voltage source to supply current to the electrodes for electrolysis of the anolyte and the catholyte.

The anode current collector has a higher chlorine overvoltage than the electrochemically active anode electrode which is bonded to the membrane, or to put is conversely, the anode has a lower chlorine overvoltage than the anode current collector. This reduces the probability of an electrochemical reaction, i.e. the evolution of chlorine, taking place at the current collector surface. The chlorine evolving reaction takes place at the bonded electrode surface not only because of its lower chlorine overvoltage but also because of the IR drops (electrolyte and gas) between the collector surface and the electrode/membrane structure.

Similarly, the cathode current collector has a higher hydrogen overvoltage than the cathode. This reduced the probability of hydrogen evolution taking place at the current collector; both because of the lower hydrogen overvoltage of the electrode itself and because of IR drops (electrolyte and gas) for ionic current flow between the collector surface and the electrode/membrane structure. By maintaining the cell voltage at the lowest level at which chlorine and hydrogen are evolved at the bonded electrodes, no gas evolution takes place at the current collectors.

An aqueous solution of alkali metal halide, preferably brine in the case of chlorine and caustic production, is supplied to the anolyte chamber to conduit 22 from a brine tank 23. Chlorine gas is removed from the anode compartment through conduit 25. Similarly an aqueous catholyte the form of distilled water or dilute caustic is introduced into the cathode compartment through an inlet conduit 26. Hydrogen gas is removed to an outlet conduit 27 and concentrated caustic through an outlet conduit 28.

Water is initially introduced into buffer chamber 17. The chamber is pressurized to force the membranes outward into firm contact with the current collectors by water molecules which accompany the sodium cations ($Na^+$) that are transported from the anode compartment into the buffer compartment. Since each sodium ion normally transports from 1–4 molecules of water, the quantity as will be pointed out in detail later) being a function of both the equivalent weight and the hydroxyl ion rejecting characteristic of the membrane) operation of the cell and movement of cations bring water into the buffer compartment. By choosing the cathode membrane so that fewer water molecules are transported with each sodium ion there is a net build up of water in the buffer compartment. The pressure build up in the buffer compartment is quite rapid with pressures in excess of 15 psi being built up in less than 30 minutes with the cell operating at 300 ASF. The cell is put into operation with the compartment initially filled with distilled water or dilute caustic at the desired or some lower pressure. If the buffer is initially charged, at the desired pressure, pressure will be maintained by continuous water transport into the compartment and by continuously bleeding the buffer compartment. A pressure control means in the form of a pressure relief valve 29 of any suitable kind is positioned in the buffer compartment outlet conduit 30. Alternatively a standpipe may be connected to the outlet conduit of the height to maintain the pressure at the desired level before overflow takes place. There is thus a continuous bleed of dilute caustic formed in the buffer compartment. The dilute caustic may be utilized directly or fed back to the cathode chamber and utilized as the catholyte. It has been found that the water transport rate or water flux across the membrane is related to its capacity for rejecting hydroxyl ions. This in turn is believed to be directly related to the equivalent weight (EW) of the membrane. By making the anode membrane a higher hydroxyl rejection membrane, either by using a higher equivalent weight (EW) membrane or by using chemically modified membrane, such as sulfonamide, etc., the net water transport across the anode membrane into the buffer compartment is greater than the net transport out of the buffer compartment.

It has also been found that membranes with a 90% hydroxyl ions rejection (i.e. 0.10 $OH^-$ transport, 3.5 molecules of $H_2O$ are transported with each cation. With a 70% hydroxyl ion rejection only 2 molecules of water are transported with each sodium ion while at approximately 63% rejection 37% $OH^-$ transport) 1.5 molecules of $H_2O$ are transported (per sodium ion). Thus, by controlling the hydroxyl rejection characteristic of a membrane, the water transport can be readily controlled thereby making a self-pressurizing arrangement possible.

The brine solution from brine tank 22 contains 150–320 grams of NaCl/liter. The chloride ion is reacted at the anode electrode electrocatalyst to produce chlorine gas. The brine may be acidified to minimize evolution of oxygen due to electrolysis of back migrating hydroxyl ions. HCl or other acids may be added to brine tank 22 to maintain the pH of the brine below 6 and preferably between 2–3.5.

Sodium ions and water molecules are transported across anode membrane 12 into buffer compartment 17. Some of the sodium ions are discharged with hydroxyl ions that have back migrated through cathode membrane 13. The remaining sodium ions and a lesser reduced number of water molecules are transported across the cathode membrane. Water molecules from the catholyte feed are decomposed at the cathode electrode to form hydrogen and hydroxyl ions. The gaseous hydrogen and the concentrated caustic produced at the cathode are then discharged from the electrolyzer and separated for utilization. The reactions occuring in the three compartment self-pressurized electrolyzer are as follows:

At the anode: (1)

$$Cl^- \longrightarrow \tfrac{1}{2} Cl_2 + e^-$$

Across the Anode Membrane; (2)

$$Na^+ . x\,H_2O \rightleftharpoons OH^-$$

Across the Cathode Membrane: (3)

$$Na^+ . y\,H_2O \rightleftharpoons OH^-$$

In the Buffer Compartment: (4)

$Na^+ . (x-y)\,H_2O$ where $x > y$

At the cathode: (5)

$$H_2O + e^- \longrightarrow \tfrac{1}{2} H_2 + OH^-$$

Overall Reaction: (6)

$$H_2O + Cl^- \longrightarrow \tfrac{1}{2} Cl_2 + \tfrac{1}{2} H_2^+$$

Since a substantial portion of the back migrating hydroxyl ions are removed from the buffer compartment in the dilute caustic effluent from the buffer, the quantity of hydroxyl ions which can migrate into the anode chamber is reduced substantially and cathodic current efficiencies of 90% or higher are readily achieved. In addition, as has been pointed out previously herein and as set forth in the co-pending Coker et al, application, by establishing a positive differential pressure in the buffer compartment the membranes are forced outwardly against the current collectors resulting in uniform, constant and controllable contact pressure between the membrane bonded electrochemically active electrodes and the current conductors. As a result substantial reductions in cell voltage for brine electrolysis are achieved. Furthermore, by virtue of the self-pressurizing arrangement of the instant invention, etc., for pressurizing an external buffer compartment feed, equipment such as pumps, storage tanks is eliminated.

A minimum pressure differential of 0.5 psi is required to maintain adequate contact between the electrode and current collectors. Below 0.5 psi partial separation between the current collectors and the electrodes result in gas evolution at the current collectors. The higher chlorine and hydrogen over-voltages characteristics of the current collectors contribute to the rise in cell voltage. In addition, erratic and varying IR drops are introduced by chlorine and hydrogen gas bubbles or gas films formed between the electrode/membrane and the current collectors as contact is lost. In fact, below 0.5 psi not only does the voltage rise rapidly but voltage fluctuations from 0.1 to 0.5 volts are noted. While a 0.5 psi differential is a minimum, the differential pressure is preferably equal to or greater than 1 psi. Operation a range of 1–5 psi is fully effective to produce constant, controllable, and uniform current collector/electrode contact pressure with a range of 1–2 psig being preferred. With a self-pressurized three compartment cell, differential pressures as high as 15 psig are easily attainable. The actual pressure at which the buffer compartment operates is readily controlled by adjusting the setting of the pressure relief valve which continually bleeds the buffer compartment.

The anode chamber housing is fabricated of a material which is resistant to the harsh anodic electrolysis conditions, i.e., is resistant to acidified brine, chlorine. Titanium is one material which is suitable for use in anode housing material.

The cathode housing may be of any material which is resistant to caustic. Nickel and stainless steel are examples of such materials. The buffer compartment may be fabricated of any non-conductive material which is resistant to caustic and may, for example, be a fluoropolymer such as a polyvinilidene fluoride commercially available from the Pennwalt Corporation under its trade name Kynar. Other materials such as PVC etc. may also be utilized. In fact, the center compartment frame may be fabricated of stainless steel as long as the stainless steel frame is electrically isolated from the anode and cathode membranes by suitable gaskets such as EPDM gaskets. The anode current collector must be of a material which is corrosion resistant, does not form a non-conductive oxide film under anodic conditions and provides good current conduction. Examples of such materials are niobium, titanium-palladium, and titanium-nickel-molybdenum alloys available from the Timet Corporation. Nickel and stainless screens or any material resistant to caustic may be utilized as the current collecting elements contacting the cathode electrode.

The permselective anode and cathode cation membranes are hydrolized copolymers of polytetrafluoroethylene and perfluorosulfonyl ethoxy vinyl ether. In a preferred embodiment the membranes are composed essentially of the sulfonated form of the above membrane and are commercially available from the DuPont Company under its trade designation Nafion. These permselective membranes may be fabricated with varying equivalent weights and varying hydroxyl rejection characteristics so that the mass transport charactertistics for the membrane for the transport of water may be readily controlled. The preferred commercially available membranes have equivalent weights from 900–1700 with the rejection characteristics of the membrane varying directly with the equivalent weight. In addition to Nafion copolymers with their sulfonic acid or sulfonate ion exchanging functional groups, membranes having other functional groups, i.e. carboxylic, phophonic, etc. may also be used. Similarly membranes which are chemically modified so that the sulfonyl fluoride functional groups are converted to form sulfonamide groups may also be used. Such chemical conversions may be readily achieved by reacting a layer of the Nafion membranes while in a sulfonyl fluoride form with ammonia, ethylene diamine (EDA), or other amines to form a sulfonamide membrane or layer. The sulfonamide membranes have good hydroxyl ion rejection characteristics and are very effective as anode membranes to maximize water transport into the buffer compartment. Nafion anode membranes are also useful provided their EW (and thus the hydroxyl rejection characteristics) is higher than that of the cathode membrane so that the water transport across the anode membrane is greater than water transport across the cathode membrane.

As is described in detail in the aforesaid LaConti application, the electrochemically active catalytic electrodes which are an integral of the membrane include electrocatalytic particles of at least one reduced platinum group metal oxide which is thereafter thermally stabilized preferably by heating the reduced oxide in the presence of oxygen at 550°–600° C. for one (1) hour. For example, the platinum group metal oxides may be produced by fusion of mixed metal salts in accordance with the Adams method or by other methods. Examples of useful platinum group metals are platinum, palladium, iridium, rhodium, ruthenium, and osmium, and mixtures of these oxides. The preferred platinum group oxides for chlorine production are reduced, temperature stabilized, oxides of ruthenium, and/or iridium. The electrode may contain electrocatalytic particles of a single reduced platinum group metal oxide. It has been found, however, that mixture of reduced platinum group metal oxides are more stable. Thus, anode electrodes of reduced oxides of ruthenium particles containing up to 25% of reduced oxide particles of Iridium and preferably 5–25% by weight have been found very stable. One or more reduced oxides of valve metals such as titanium, tantalum, niobium, zirconium, hafnium, vanadium, or tungsten may be added to stabilize the electrode in oxygen, chlorine and the generally harsh electrolysis conditions. The valve metal may be included in amounts of up to 50% by weight with the preferred amount being 25–50% by weight. In addition, electroconductive extenders such as graphite which have excellent conductivity with low halogen overvoltages may be utilized in addition to the platinum group and valve metals as they are substantially less expensive than the platinum group and valve metal groups. The graphite may be present in amounts of up to 50% by weight and preferably from 10–30% by weight when added to the electrodes.

The cathode may similarly be a bonded mass of fluorocarbon and catalytic particles of platinum and valve group metals plus graphite. Alternatively the cathode is simply a bonded mass of fluorocarbon and platinum black particles. Also, nickel, cobalt, steel carbide, spinels, manganese, etc. may be utilized as the electrochemically active cathode particles.

In an alternative construction, continuous bleed of the self-pressurized buffer compartment may be provided by a liquid pervious cathode diaphragm in lieu of a stand pipe or pressure relief valve. The membrane may take the form of a microporous diaphragm such as the one sold by the DuPont Company under its trade designation Nafion 701. The liquid pervious cathode separator permits transport of liquid from the buffer compartment to the cathode compartment. The average pore size, % void volume, etc. is so chosen that the proper pressure is maintained in the buffer compartment with the dilute caustic formed in the self-pressurized buffer compartment becoming part of the catholyte feed. The buffer compartment is modified to remove the pressure relief valve, although a hand operated or other manually operated valve may be provided for further removal of the fluid from the center compartment.

The porosity, etc., of the cathode side membrane is chosen so that the feed flow rate out of the buffer compartment maintains the desired pressure in the buffer compartment by ensuring that water transport across the anode membrane into the buffer compartment exceeds the water transport through the porous diaphragm out of the buffer compartment.

EXAMPLE 1

Figure 2:
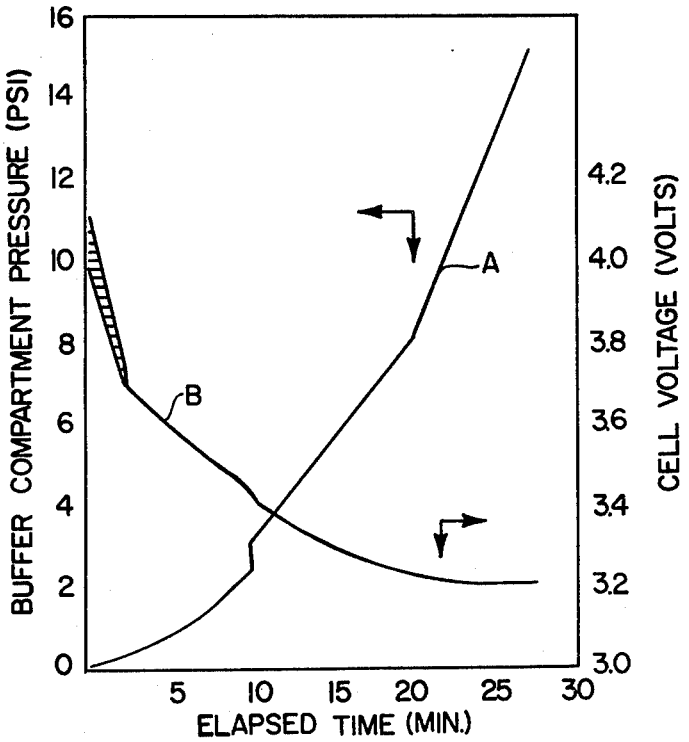
FIG. 2 is a graphic depiction of pressure build up and cell voltage with time.

A three compartment cell was constructed having a titanium anode housing, a nickel cathode housing, separated by a 0.112 inch buffer compartment frame fabricated of Kynar (polyvinilidene fluoride). The buffer compartment frame was constructed without any inlet conduit and an exit port was fitted with a stainless steel needle valve for pressure control. A 10 mil unsupported sulfonamide membrane of the type sold by DuPont under the trade designation Nafion 042 was used as the anode membrane and a 12 mil 1200 EW Nafion 120 membrane as the cathode. The anode in the form of 3"×3" 6 mg/cm$^2$ (Ru-25% IR) $0_x$ 15% T-30 electrode was bonded to the side of the membrane facing the anode housing. The cathode electrode consisted of a 3"×3" bonded mixture of platinum black and 15% T-30 tetrafluoroethylene. Platinum black loading was 4 mg/cm$^2$. A nickel cathode current collector and a Ti-Pd alloy collector were respectively positioned against the cathode and anode. Saturated brine at 84°–85° C. was introduced to anode compartment. Distilled at ambient pressure was introduced into the buffer compartment. The cell was then operated at 300 ASF and pressure was allowed to build up in the buffer compartment by water transport across the membranes. The pressure developed in the buffer compartment and the cell voltage as functions of time are shown in Table I and illustrated by curves A and B of FIG. 2.

TABLE I

| Elapsed Time (min) After Initiating Cell Operation | Pressure P Buffer Comp (PSI) | Cell Voltage |
|---|---|---|
| 2.5 | 0.2 | 3.64 |
| 5 | 0.4 | 3.60 |
| 7 | 1.2 | 3.50 |
| 9 | 2.0 | 3.46 |
| 10 | 2.6 | 3.42 |
| 11 | 3.4 | 3.38 |

TABLE I-continued

| Elapsed Time (min) After Initiating Cell Operation | Pressure P Buffer Comp (PSI) | Cell Voltage |
|---|---|---|
| 12 | 4.2 | 3.34 |
| 14 | 5.0 | 3.32 |
| 16 | 6.0 | 3.30 |
| 18 | 7.0 | 3.26 |
| 20 | 8.0 | 3.24 |
| 22.5 | 10.0 | 3.22 |
| 24 | 12.0 | 3.22 |
| 25 | 13.0 | 3.22 |
| 27 | 15.0 | 3.21 |

As may be seen, less than 30 minutes is required to reach a pressure differential in excess of 15 psi. Pressure differentials of 2–4 psi are reached 9–10 minutes after initiation of cell operation. Curve B illustrates the cell voltage as function of time and pressure build up in the cells. For example, at roughly 10 minutes when the pressure differential has reached approximately 2 lbs. the cell voltage is approximately 3.46 volts. It is apparent from the data shown in FIG. 2 that self-pressurization of a three compartment cell is readily accomplished by passing current through the cell thereby eliminating the need for external pumping and pressurization. The self-pressurization of the buffer compartment is achieved by utilizing membranes between the anode and cathode and buffer compartment which has the transport characteristic such that the transport into the buffer compartment is greater than the transport out of the buffer compartment.

EXAMPLE 2

A three compartment cell was constructed with a titanium anode housing and a nickel cathode housing separated by a buffer compartment frame of stainless steel separated from the anode and cathode housings and the membranes by a non-conductive EPDM gaskets. The thickness of the buffer compartment frame was 0.25 in and included an exit port fitted with a stainless steel needle valve to permit pressure buildup and continuous bleed of the caustic formed in the buffer compartment.

The anode membrane was a Nafion 315 membrane which is a laminate having a 1500 EW and an 1100 EW layer. The 1500 EW layer of the anode membrane was positioned to face the buffer chamber. The cathode was 1200 EW Nafion 120 membrane. One (1) square ft. anode and cathode electrodes were respectively bonded to the anode and cathode membranes. The anode and cathode catalytic electrode compositions were identical to those described in Example 1. The cell was operated at a current density of 300 ASF and saturated by brine at 69° C. and 1 psig was introduced into the anode chamber and distilled water at ambient pressure and 60° C. to the cathode chamber. The buffer compartment was self-pressurized to various pressure levels by adjusting the setting on the stainless steel needle valve and the cell voltage at 300 ASF was measured for the various pressure differentials. Table II shows the cell voltages as a function of the differential pressure established in the self-pressurized buffer compartment.

TABLE II

| Differential Pressure (PSI) | Cell Voltage (v) |
|---|---|
| 0.5 | 3.69 |
| 1.0 | 3.68 |

TABLE II-continued

| Differential Pressure (PSI) | Cell Voltage (v) |
|---|---|
| 2.0 | 3.66 |
| 4.0 | 3.63 |
| 6.0 | 3.62 |
| 10.0 | 3.618 |
| 13.0 | 3.61 |

As may be seen from the data in Table II the one square foot electrode, the voltage drops from 3.69 at 0.5 psi to 3.61 at 13 psi. Thus a large cell has excellent performance utilizing a self-pressurized buffer compartment.

EXAMPLE 3

Figure 3:
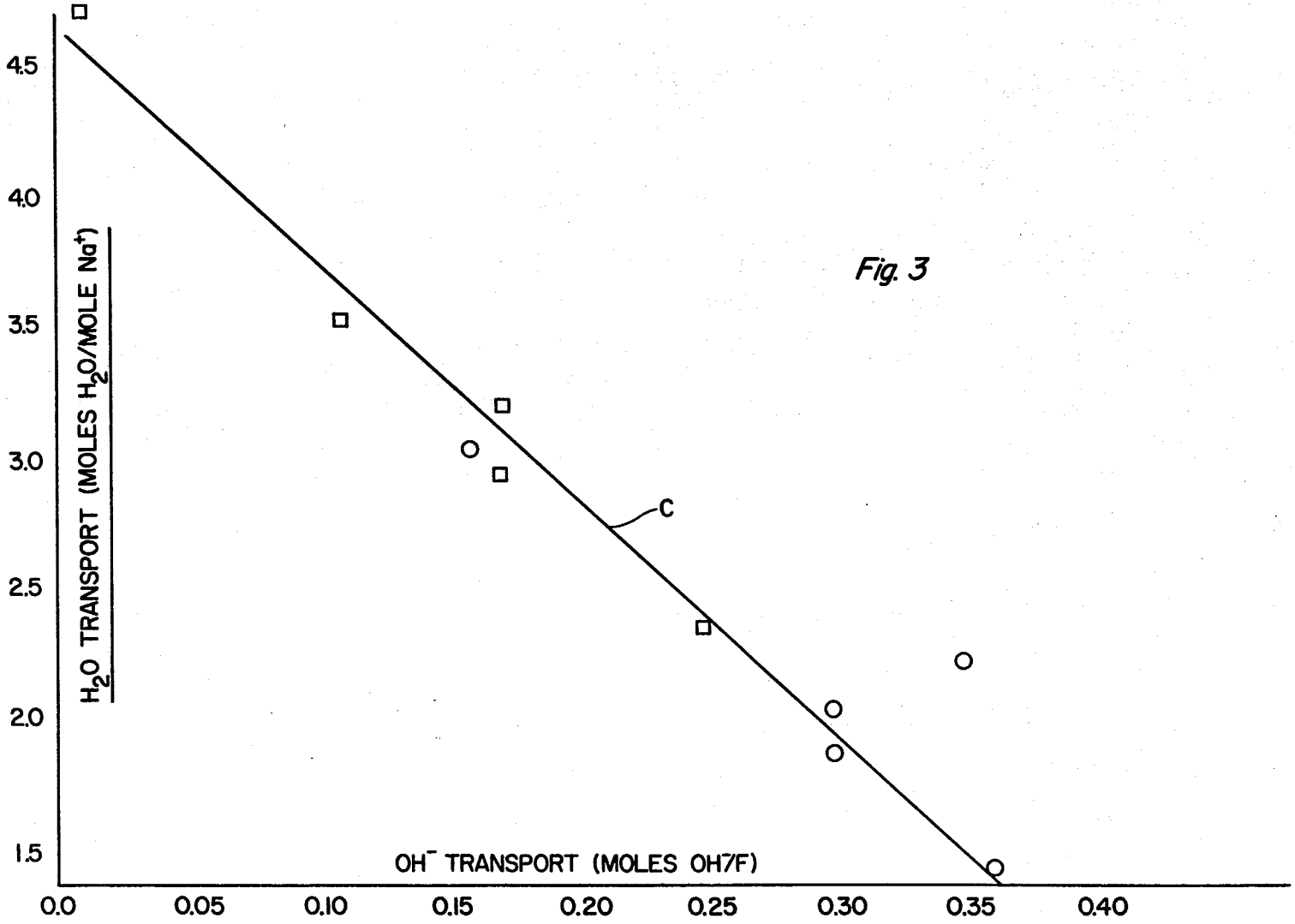
FIG. 3 is a graphic depiction of the membrane water transport as a function of membrane hydroxyl rejection.

Another cell was constructed utilizing a cell constructed according to Example 2 with a 1200 EW Nafion 120 cathode membrane and an unsupported sulfonamide Nafion 0042 as the anode membrane. Saturated brine at 75° C. was introduced into the anode compartment and distilled water in the cathode compartment. The buffer compartment was self-pressurized in the manner described. The hydroxyl ion transport characteristic for such a membrane was determined in terms of moles of $OH^-$ per Faraday back migrating through the membrane. The water transport characteristics of the membranes in molecules per molecules of sodium ion as a function of FIG. 3 shows the relationship between hydroxyl ion transport characteristics and the capacity of the membrane to transport water along the cations. With $OH^-$ backmigration being less than 0.05 moles per Faraday, approximately 4.0 molecules of water are transported with each sodium ion. With a hydroxyl backmigration of 0.10 (i.e. a Faraday efficiency of 90%) 3.5 molecules of water are transported with each sodium ion. At 0.30 only 2 molecules of water are transported with each sodium ion.

It will be obvious that by controlling the hydroxyl characteristic of the membrane which may be achieved by controlling the equivalent weight (and hence the number of water molecules/ion exchanging sulfonic acid radical or sulfonate), the $H_2O$ transport across the membranes may be controlled.

It will be evident from the preceding description that self-pressurizing the buffer compartment results in excellent current collector/electrode contact and substantial reductions in cell voltage at current densities of 300 ASF or more without requiring auxilliary equipment such as pumps, etc., for pressurizing the buffer compartment feed.

While the instant invention has been shown in connection with preferred embodiments thereof, the invention is by no means limited thereto since other modifications of the instrumentalities employed and of the steps of the process carried out may be made and fall within the scope of the invention. It is contemplated by the appended claims to cover any such modifications that fall within the true scope and spirit of this invention.

What is claimed as new and desired to be secured by a Letter of Patent by the United States is:

1. A process for producing halogens which comprises electrolyzing an aqueous alkali metal halide in a three compartment cell having anode and cathode electrodes separated by two ion transporting membranes, the electrochemically active elements of at least one of said electrodes being physically bonded to one of said membranes at a plurality of points to form a unitary electrode-membrane structure, applying potential from a potential source to the bonded electrode by an electron current conducting structure in contact with the bonded electrode, pressurizing the buffer compartment in the three compartment cell solely by the transport of water through the ion transporting membrane to establish a positive pressure differential between the buffer and the other compartments which forces the membranes outward and the unitary electrode-membrane against the electron current conducting structure to minimize the potential required for electrolysis.

2. The process according to claim 1 wherein the water transport across the anode membrane into the buffer compartment is greater than the water transport out of the buffer compartment across the cathode membrane to establish the pressure differential in the buffer compartment.

3. The process according to claim 2 in which the anode membrane has the higher equivalent weight than the cathode membrane.

4. The process according to claim 2 wherein the hydroxyl ion rejection characteristics of the anode membrane is greater than the hydroxyl ion rejection characteristics of the cathode membrane.

5. The process according to claim 1 wherein the buffer compartment is maintained at a positive pressure differential of at least 0.5 psi.

6. The process according to claim 1 wherein the buffer compartment is maintained as a positive pressure differential equal to or greater than 1 psi.

7. A process for generating chlorine and caustic in a three compartment cell separated by two ion transporting membranes whih comprises electrolyzing an aqueous alkali metal chloride and water at anode and cathode electrodes separated by the ion transporting membranes, at least one of the electrodes taking the form of electrochemically active particles physically bonded to one of the membranes to form a unitary electrode membrane structure, operating the buffer compartment of the three compartment cell at a positive pressure differential with respect to the other compartments, pressurizing the buffer compartment solely by passing current through the cell to transport water into the buffer compartment with ions transported across the membranes so that the sole source of water for the buffer compartment is transported through the ion transporting membranes

8. The process according to claim 7 wherein the positive pressure differential in the buffer compartment due to the transport of water through the membranes is at least 0.5 psi.

9. The process according to claim 8 wherein the equivalent weight of the membranes are such that water transported into the buffer compartment exceeds the water transport out of the buffer compartment.

10. The process according to claim 9 wherein the anode membrane has a greater equivalent weight than the cathode membrane.

11. The process according to claim 9 wherein the hydroxyl ion rejection characteristic of the anode membrane is greater than that of the cathode membrane.

12. The process according to claim 7 wherein the water transport characteristics of the two membranes are selected so that water transported with ions into the buffer compartment is greater than the water transported with ions out of the buffer compartment.

13. The process according to claim 12 wherein the cathode membrane is liquid pervious to permit water flow out of the buffer compartment.

14. An electrolytic cell for the electrolysis of aqueous compounds comprising (a) a housing, (b) at least two ion transporting membranes separating said housing into anode, cathode and buffer compartments, said ion transporting membranes having different water transport characteristics, (c) anode and cathode electrodes in said anode and cathode compartment, at least one of the said electrochemically active electrodes being physically bonded to its associated membrane to form a unitary electrode-membrane structure, (d) an electron current conducting structure positioned in contact with the electrode bonded to the membrane for applying electrolyzing potential to the electrode, (e) means for introducing anolyte and catholyte to the anode and cathode compartment, (f) means to produce current flow through said cell to transport water across said membranes into the buffer compartment to establish a positive pressure differential between the buffer compartment and the remaining compartments whereby the ion transporting membranes are forced outwardly and the unitary electrode-membrane is brought into firm contact with the electron current conducting structure, (g) means to remove electrolysis products from all three compartments.

15. The electrolytic cell according to claim 14 wherein the anode membrane has a higher water transport characteristic than the cathode membrane whereby more water is transported into the buffer compartment from the anode than is transported across the cathode membrane to the cathode compartment.

16. The electrolytic cell according to claim 15 wherein both the anode and the cathode electrodes are bonded to the membranes and are in physical contact with electron current conducting structures whereby the self-pressurized buffer compartment forces both electrodes into firm contact with the electron current conducting structures.

17. The electrolytic cell according to claim 16 wherein the anode and cathode electrodes bonded to the membranes each comprise a layer of electrochemically active particles bonded to the surface of the membranes.

18. The electrolytic cell according to claim 17 wherein the electrochemically active particles bonded to the anode and cathode membranes are bonded together by polymeric fluorocarbon particles.

19. The electrolytic cell according to claim 15 wherein the anode membrane has a higher equivalent weight than the cathode membrane.

20. The electrolytic cell according to claim 15 wherein the anode membrane has a greater hydroxyl ion rejection characteristics than the cathode membrane.

21. The electrolytic cell according to claim 15 wherein the cathode membrane is liquid pervious.

* * * * *